US010920778B2

(12) United States Patent
Kimura et al.

(10) Patent No.: US 10,920,778 B2
(45) Date of Patent: Feb. 16, 2021

(54) HEAT EXCHANGER FOR GAS COMPRESSOR

(71) Applicant: KOBE STEEL, LTD., Hyogo (JP)

(72) Inventors: Yasumasa Kimura, Hyogo (JP); Kazuki Tsugihashi, Hyogo (JP); Yosuke Fukushima, Hyogo (JP)

(73) Assignee: KOBE STEEL, LTD., Hyogo (JP)

( * ) Notice: Subject to any disclaimer, the term of this patent is extended or adjusted under 35 U.S.C. 154(b) by 595 days.

(21) Appl. No.: 14/908,447

(22) PCT Filed: Jul. 9, 2014

(86) PCT No.: PCT/JP2014/068362
§ 371 (c)(1),
(2) Date: Jan. 28, 2016

(87) PCT Pub. No.: WO2015/016026
PCT Pub. Date: Feb. 5, 2015

(65) Prior Publication Data

US 2016/0169229 A1 Jun. 16, 2016

(30) Foreign Application Priority Data

Aug. 1, 2013 (JP) ..... 2013-160470

(51) Int. Cl.
*F04C 29/04* (2006.01)
*F28D 7/16* (2006.01)
*F04C 29/06* (2006.01)

(52) U.S. Cl.
CPC ..... *F04C 29/04* (2013.01); *F04C 29/063* (2013.01); *F28D 7/16* (2013.01); *F28F 2265/28* (2013.01)

(58) Field of Classification Search
CPC ..... F04C 29/04; F04C 29/063; F28D 7/16; F28F 2265/28

(Continued)

(56) References Cited

U.S. PATENT DOCUMENTS 2,096,285 A * 10/1937 Lord ..... F28D 7/024 165/135
2,390,380 A * 12/1945 McCollum ..... B64D 13/08 126/116 R (Continued)

FOREIGN PATENT DOCUMENTS

JP 1973044893 10/1977
JP 52-136266 11/1977

(Continued)

OTHER PUBLICATIONS

Translation of the International Search Report; PCT/JP2014/068362; dated Sep. 22, 2014.

(Continued)

*Primary Examiner* — Tho V Duong
*Assistant Examiner* — Raheena R Malik
(74) *Attorney, Agent, or Firm* — Studebaker & Brackett PC

(57) ABSTRACT

A heat exchanger includes: a heat exchange section through which a compressed gas flows; an upstream header section that is provided on an upstream side of the heat exchange section and communicates with the heat exchange section; a downstream header section that is provided on an downstream side of the heat exchange section and communicates with the heat exchange section; a gas inlet pipe that is connected to a wall surface of the upstream header section; and a gas outlet pipe that is connected to a wall surface of the downstream header section. A filter-cum-sound absorbing material of a porous material is mounted on an inner wall surface of at least one of the upstream header section and the downstream header section. The inner wall surface faces the heat exchange section.

9 Claims, 6 Drawing Sheets

(58) Field of Classification Search
USPC ..... 165/135
See application file for complete search history.

(56) References Cited

U.S. PATENT DOCUMENTS

| | | | | |
|---|---|---|---|---|
| 2,482,988 | A * | 9/1949 | McCollum | B64D 13/08 126/116 R |
| 3,692,140 | A * | 9/1972 | Smith | B64F 1/26 181/213 |
| 3,786,791 | A * | 1/1974 | Richardson | F01N 1/04 123/65 E |
| 3,977,493 | A * | 8/1976 | Richardson | F01N 1/02 181/253 |
| 4,450,932 | A * | 5/1984 | Khosropour | F01N 3/043 181/211 |
| 5,545,861 | A | 8/1996 | Morimoto | |
| 5,979,598 | A * | 11/1999 | Wolf | F02M 35/1266 181/249 |
| 7,063,134 | B2 * | 6/2006 | Poole | F01N 5/02 165/135 |
| 7,389,852 | B2 * | 6/2008 | Voss | F01N 1/003 165/135 |
| 8,863,891 | B2 * | 10/2014 | Glav | B60R 13/0838 180/69.22 |
| 2002/0050345 | A1 | 5/2002 | Miura et al. | |
| 2004/0050618 | A1 * | 3/2004 | Marocco | F01N 1/02 181/248 |
| 2005/0082044 | A1 | 4/2005 | Miura et al. | |
| 2011/0005856 | A1 * | 1/2011 | Larson | F01N 1/04 181/211 |
| 2013/0264037 | A1 | 10/2013 | Otsubo et al. | |

FOREIGN PATENT DOCUMENTS

| | | | |
|---|---|---|---|
| JP | S52-136266 | A | 11/1977 |
| JP | 58-046985 | | 9/1981 |
| JP | 1981139842 | | 3/1983 |
| JP | 63-167081 | | 10/1988 |
| JP | 1987053461 | | 10/1988 |
| JP | 6-83365 | | 3/1994 |
| JP | 08-086587 | | 4/1996 |
| JP | 10-39878 | A | 2/1998 |
| JP | 2002-206876 | | 7/2002 |
| JP | 2003-97361 | A | 4/2003 |
| JP | 2008-261338 | A | 10/2008 |
| JP | 2010-60196 | A | 3/2010 |
| JP | 2011-169522 | A | 9/2011 |
| JP | 2012-137254 | | 7/2012 |
| JP | 2012-241655 | A | 12/2012 |
| KR | 10-20110064381 | A | 6/2011 |

OTHER PUBLICATIONS

Translation of the Written Opinion; PCT/JP2014/068362; dated Sep. 22, 2014.

* cited by examiner

VI – VI Sectional View

VII – VII Sectional View

HEAT EXCHANGER FOR GAS COMPRESSOR

TECHNICAL FIELD

The present invention relates to a heat exchanger for a gas compressor.

BACKGROUND ART

For example, a technique regarding a heat exchanger for an air compressor is disclosed in PTL 1. The heat exchanger for the air compressor described in PTL 1 is configured so that a low-temperature chamber and a high-temperature chamber are partitioned by a partition plate, and the low-temperature chamber and the high-temperature chamber are alternately stacked. The low-temperature chambers are provided on both end sides in a stacking direction and a flow direction of a low-temperature side fluid in the low-temperature chamber and a flow direction of a high-temperature side fluid in the high-temperature chamber are substantially orthogonal to each other. The heat exchanger is used as an intercooler or aftercooler of a screw compressor and is described in PTL 1.

CITATION LIST

Patent Literature

[PTL 1] JP-A-2002-206876

SUMMARY OF INVENTION

Technical Problem

Here, in the air compressor, e.g. the screw type that is used in a factory as an air source, a compressor body and a peripheral device often become a major noise source by pressure pulsation generated in association with a volume change in a compression step.

In an oil-free type multistage compressor, compression efficiency is improved by disposing the intercooler between a plurality of compression stages. In addition, the aftercooler is often disposed also on a downstream side of a final compression stage to decrease a temperature of compressed air.

If the compressed air is rapidly cooled within the heat exchanger (the intercooler or the aftercooler), moisture contained therein is liquefied, to become mist (fine water droplets), and then is present in the compressed air. Mist causes rust in a rotor of the compressor if the compressor is stopped for a long period of time. Thus, mist is removed from the compressed air by passing the compressed air after cooling through a filter. Typically, mist is removed from the compressed air by providing the filter (mist filter) within a header section of the heat exchanger on a downstream side of a heat exchange section.

However, since the filter of the related art collects mist when air passes through an inside thereof, the filter generates air resistance, whereby the air resistance becomes a cause of lowering performance of the compressor.

The present invention is made in view of the above-described situation and an object of the present invention is to provide a heat exchanger for a gas compressor in which air resistance of a header section can be reduced, and which contributes to reduction of noise generated from the compressor while removing mist contained in compressed air in a header section of the heat exchanger.

Technical Solution

The present invention relates to a heat exchanger for a gas compressor. The heat exchanger includes: a heat exchange section through which a compressed gas flows: an upstream header section that is provided on an upstream side of the heat exchange section and communicates with the heat exchange section; a downstream header section that is provided on an downstream side of the heat exchange section and communicates with the heat exchange section; a gas inlet pipe that is connected to a wall surface of the upstream header section except a wall surface of the upstream header section which faces the heat exchange section; and a gas outlet pipe that is connected to a wall surface of the downstream header section except a wall surface of the downstream header section which faces the heat exchange section. A filter-cum-sound absorbing material of a porous material is mounted on an inner wall surface of at least one of the upstream header section and the downstream header section, in which the inner wall surface faces the heat exchange section.

Advantageous Effects of Invention

According to the heat exchanger in the present invention, it is possible to reduce the air resistance of the header section and to reduce also noise generated from the compressor while removing mist contained in the compressed air in the header section of the heat exchanger.

DESCRIPTION OF EMBODIMENTS

Hereinafter, embodiments of the present invention will be described with reference to the drawings. In the following embodiments, a case where a heat exchanger in the present invention is applied to a screw compressor (screw-type gas compressor) is exemplified. But the heat exchanger in the present invention can be also applied to a reciprocating-type and a turbo-type (centrifugal-type) gas compressor.

(Configuration of Screw Compressor)

Figure 1:
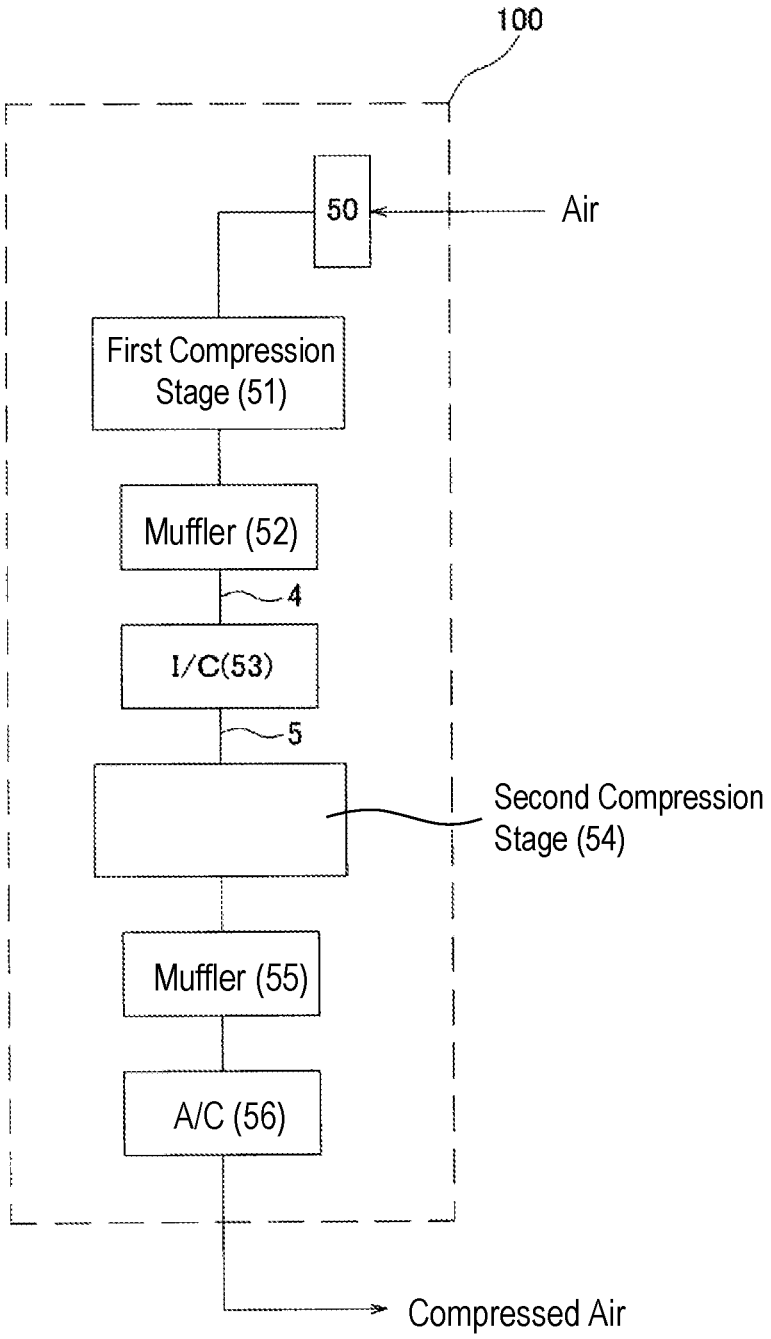
FIG. 1 is a block diagram illustrating a screw compressor including a heat exchanger according to a first embodiment of the present invention.

As illustrated in FIG. 1, a screw compressor 100 is a two-stage type gas compressor including a filter 50, a first compression stage 51 (compression first stage), a muffler 52, a heat exchanger 53 (intercooler), a second compression stage 54 (compression second stage), a muffler 55, and a heat exchanger 56 (aftercooler) in this order from a side on which air to be compressed is introduced. Moreover, it is also possible to apply the heat exchanger in the present invention to a single-stage type screw compressor (gas compressor) and a screw compressor (gas compressor) having three stages or more compression stages.

The filter 50 is provided to remove dust and the like contained in the air. The first compression stage 51 is a main portion of the screw compressor 100 for compressing the air and includes a screw rotor (same for the second compression stage 54).

The heat exchanger 53 (intercooler) is a cooler for decreasing a temperature of a compressed air of which the temperature is increased by being compressed by the first compression stage 51. The heat exchanger 56 (aftercooler) is a cooler for decreasing the temperature of the compressed air of which the temperature is increased by being compressed by the second compression stage 54.

(Configuration of Heat Exchanger of First Embodiment)

Figure 2A:
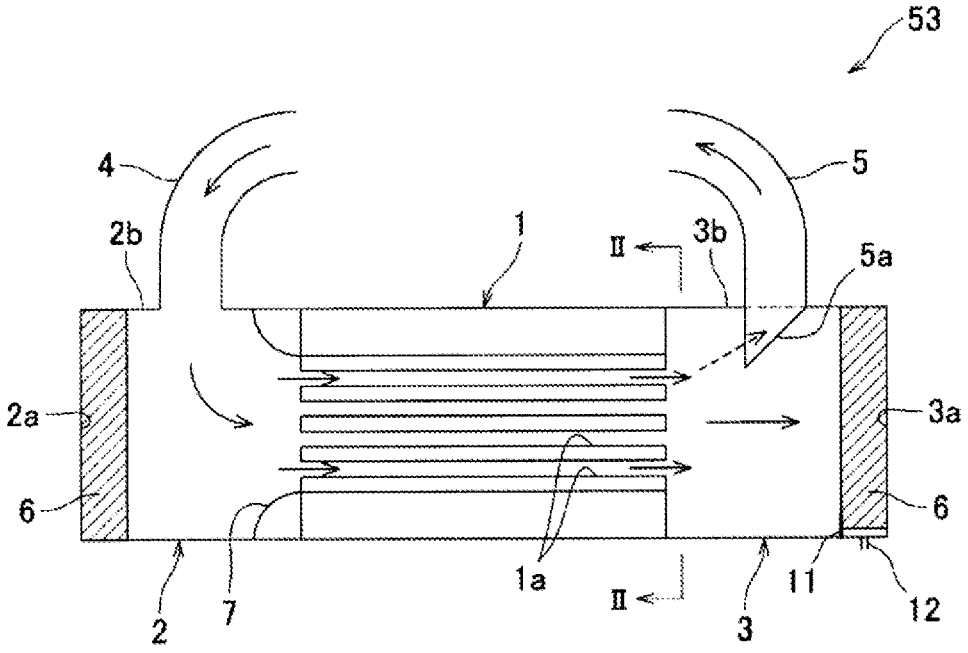
FIG. 2A is a side sectional view of the heat exchanger according to the first embodiment of the present invention.
Figure 2B:
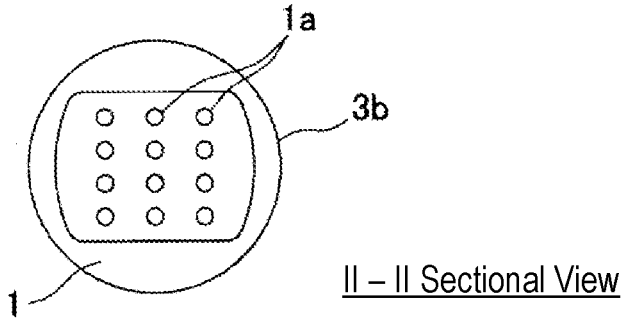
FIG. 2B is a sectional view that is taken along line II-II of FIG. 2A.

A structure of the heat exchanger 53 as the intercooler illustrated in FIG. 1 is illustrated in FIGS. 2A and 2B. FIG. 2A is a side sectional view of the heat exchanger 53 and FIG. 2B is a sectional view that is taken along line II-II of FIG. 2A. Moreover, a structure of the heat exchanger 56 as the aftercooler illustrated in FIG. 1 may be the same structure as the structure of the heat exchanger 53 illustrated in FIGS. 2A and 2B. Furthermore, the heat exchanger 53 as the intercooler is a heat exchanger of a structure of the related art (known technology) and only the structure of the heat exchanger 56 as the aftercooler may be the structure of the heat exchanger 53 illustrated in FIGS. 2A and 2B.

As illustrated in FIGS. 2A and 2B, the heat exchanger 53 is, for example, a shell-and-tube type water-cooled heat exchanger and is a cylindrical heat exchanger including a heat exchange section 1 through which the compressed air flows, a upstream header section 2 that is provided on an upstream side of the heat exchange section 1, and a downstream header section 3 that is provided on a downstream side of the heat exchange section 1. The heat exchanger may be a rectangular heat exchanger.

<Heat Exchange Section>

The heat exchange section 1 has a cylindrical shape and a plurality of straight heat exchange pipes 1*a* are provided inside thereof side by side. Cooling water (coolant) flows around the heat exchange pipes 1*a*. The compressed air that is to be cooled flows through an inside of the heat exchange pipe 1*a*. A portion in which the plurality of the heat exchange pipes 1*a* are provided is referred to as a pipe bundle section. The plurality of the heat exchange pipes 1*a* are disposed in parallel to each other. Piping for inflow and outflow of the cooling water and the like are not illustrated.

<Upstream Header Section>

The upstream header section 2 communicating with the heat exchange section 1 has a cylindrical shape and is provided so as to extend from the heat exchange section 1 to an upstream side thereof.

A gas inlet pipe 4 is connected to a side wall surface 2*b* (wall surface of the upstream header section 2 except a wall surface of the upstream header section 2 facing the heat exchange section 1) of an upper surface of the upstream header section 2. In the embodiment, the gas inlet pipe 4 is connected to the upper surface of the upstream header section 2 in a state where the heat exchanger 53 is horizontally provided (axial direction of the heat exchanger 53 is horizontal).

In addition, a filter 6 (filter-cum-sound absorbing material (mist filter-cum-sound absorbing material)) of a porous material is mounted on an inner wall surface 2*a* of the upstream header section 2 facing the heat exchange section 1 in a close contact state. The filter 6 of the porous material is also referred to as a demister, is, for example, made of metal fibers by weaving the metal fibers in a net, and density thereof is higher than that of a general filter of the porous material so that the filter 6 has sound absorption properties. The density of the filter 6 is, for example, 600 kg/m$^3$ and a range of the density of the filter 6 having sound absorption properties is, for example, 200 kg/m$^3$ to 800 kg/m$^3$. All filters having the density that does not fall within the range of 200 kg/m$^3$ to 800 kg/m$^3$ do not necessarily have sound absorption properties. The "porous material" refers a structure having fine voids inside thereof. As a "porous material" other than the structure obtained by weaving the fibers and wire metal such as stainless steel wool or stainless steel wires, foamed metal having continuous air bubbles inside thereof and the like can be exemplified (same for the filter 6 disposed within the downstream header section 3 described below).

The gas inlet pipe 4 is connected to the side wall surface 2*b* of the upstream header section 2 and the filter 6 having a predetermined thickness is mounted on the inner wall surface 2*a* of the upstream header section 2 facing the heat exchange section 1. Thus, the compressed air to enter the inside of the upstream header section 2 from the gas inlet pipe 4 enters an inside of the filter 6 from one surface (for example, a front surface) of the filter 6 and then the total amount thereof does not exit (briefly speaking, does not pass through the filter 6) from the other surface (for example, a rear surface). At least one of the compressed air entering the inside of the upstream header section 2 from the gas inlet pipe 4 collides with the filter 6. That is, the gas inlet pipe 4 is disposed with respect to the filter 6 such that the compressed air to enter the inside of the upstream header section 2 from the gas inlet pipe 4 does not pass through the filter 6 from the front surface to the rear surface thereof, and collides with the filter 6.

In the embodiment, the cylindrical filter 6 having a predetermined thickness is mounted on substantially the entire surface of the inner wall surface 2*a* of the upstream header section 2 facing the heat exchange section 1. It is not necessary to mount the filter 6 on substantially the entire surface of the inner wall surface 2*a*.

A bell mouth 7 (rectifying unit (resistance reducing unit)) having a ring shape as a whole of which an inner diameter is gradually reduced toward the downstream side is disposed on the heat exchange section 1 side within the upstream header section 2.

<Downstream Header Section>

The downstream header section 3 communicating with the heat exchange section 1 has a cylindrical shape and is provided so as to extend from the heat exchange section 1 to a downstream side thereof.

A gas outlet pipe 5 is connected to a side wall surface 3*b* (wall surface of the downstream header section 3 except a wall surface of the downstream header section 3 facing the heat exchange section 1) of the downstream header section 3. In the embodiment, the gas outlet pipe 5 is connected to the upper surface of the downstream header section 3 in a state where the heat exchanger 53 is horizontally provided (axial direction of the heat exchanger 53 is horizontal).

In addition, similar to the upstream header section 2, a filter 6 (filter-cum-sound absorbing material (mist filter-cum-sound absorbing material)) of the porous material having the sound adsorption properties is mounted on an inner wall surface 3*a* of the downstream header section 3 facing the heat exchange section 1 in a close contact state.

The gas outlet pipe 5 is connected to the side wall surface 3*b* of the downstream header section 3 and the filter 6 having a predetermined thickness is mounted on the inner wall surface 3*a* of the downstream header section 3 facing the heat exchange section 1. Thus, the compressed air entering the inside of the downstream header section 3 from the heat exchange section 1 enters an inside of the filter 6 from one surface (for example, a front surface) of the filter 6 and then the total amount thereof does not exit (briefly speaking, does not pass through the filter 6) from the other surface (for example, a rear surface). At least one of the compressed air entering the inside the downstream header section 3 from the heat exchange section 1 collides with the filter 6. That is, the gas outlet pipe 5 is disposed with respect to the filter 6 such that the compressed air to enter the inside of the downstream header section 3 from the heat exchange section 1 does not pass through the filter 6 from the front surface to the rear surface thereof and collides with the filter 6.

In the embodiment, the cylindrical filter 6 having a predetermined thickness is mounted on substantially the entire surface of the inner wall surface 3*a* of the downstream header section 3 facing the heat exchange section 1. Moreover, it is not necessary to mount the filter 6 on substantially the entire surface of the inner wall surface 3*a*.

A gap is provided between a lower surface of the filter 6 and a bottom surface of the downstream header section 3, and the gap is closed by a plate 11. A drain 12 (nozzle for drain) is mounted on the bottom surface of the downstream header section 3 positioned below the filter 6.

Furthermore, in the embodiment, the gas outlet pipe 5 is extended to the inside of the downstream header section 3. Then, a tip portion of the gas outlet pipe 5 is cut diagonally such that an opening 5*a* of the gas outlet pipe 5 within the downstream header section 3 faces the filter 6 (in other words, faces in a direction opposite to the heat exchange section 1).

(Operations and Effects)

As a flow of the compressed air is indicated by arrows in FIG. 2A, the compressed air which flows into the upstream header section 2 from the gas inlet pipe 4 is discharged to the inside of the downstream header section 3 through the plurality of the heat exchange pipes 1*a* of the heat exchange section 1. In this case, the compressed air is water-cooled and the temperature thereof is decreased in the heat exchange section 1. The compressed air, of which the temperature is decreased, discharged to the inside of the downstream header section 3 flows straight in the inside of the downstream header section 3 and collides with the filter 6. Mist contained in the compressed air is collected in the filter 6 when the compressed air collides with the filter 6 and is separated from the compressed air. The drain 12 is provided so as to discharge accumulated water.

In the type in which mist is collected in the filter 6 by colliding the compressed air with the filter 6, since mist contained in the air is removed and is escaped to the outside of the filter 6, an air resistance of the header section (downstream header section 3) of air (compressed air) having a high pressure is reduced, as compared to the case of a conventional type in which the total amount of a fluid passes through the filter.

In addition, since a wall surface (inner wall surface 3*a*) reflecting sound exists on a rear side of the filter 6 having sound absorption properties, the sound is reflected on the inner wall surface 3*a* and the sound passes through the filter 6 having sound absorption properties at least two times. Thus, a sound absorption effect of the filter 6 having sound absorption properties is further improved.

In addition, in the embodiment, as described above, the filter 6 is also mounted on the inner wall surface 2*a* of the upstream header section 2 facing the heat exchange section 1 in addition to the inner wall surface 3*a* of the downstream header section 3 facing the heat exchange section 1. Similar to the case of the filter 6 within the downstream header section 3, since the wall surface (inner wall surface 2*a*) reflecting the sound exists on the rear side of the filter 6 within the upstream header section 2, the sound absorption effect of the filter 6 having sound absorption properties is further improved.

Moreover, for the filter 6 within the upstream header section 2, since a location (portion of the inner wall surface 2*a* facing the heat exchange section 1) of the filter 6 is a portion within the upstream header section 2 in which a flow speed is relatively slow, the filter 6 does not become a large resistance of the flow within the upstream header section 2 (same for the filter 6 within the downstream header section 3).

Here, since the compressed air that is cooled by the heat exchange section 1 is discharged to the downstream header section 3, the compressed air often contains mist. On the other hand, since the compressed air that is compressed by the first compression stage 51 flows into the upstream header section 2, it may be rare that mist is contained in the compressed air that flows into the upstream header section 2, as compared to the downstream header section 3. However, it is not possible to say that mist is never contained in the compressed air that flows into the upstream header section 2. That is, if mist is contained in the compressed air that flows into the upstream header section 2, similar to the filter 6 within the downstream header section 3, the filter 6 within the upstream header section 2 exerts a function of removing mist from the compressed air.

As described above, according to the heat exchanger 53 according to the embodiment, it is possible to reduce the air resistance of the header section and also to reduce noise generated from the compressor while removing mist contained in the compressed air by the header sections (upstream header section 2 and the downstream header section 3) of the heat exchanger 53.

Moreover, in the embodiment, the case where the filters 6 are respectively mounted on the inner wall surfaces 2*a* and 3*a* of the upstream header section 2 and downstream header section 3, facing the heat exchange section 1, is illustrated. But if the filter 6 is mounted on the inner wall surface facing the heat exchange section 1 in at least one of the upstream header section 2 and the downstream header section 3, it is possible to obtain the above-described effects.

In addition, in the embodiment, the gas outlet pipe 5 extends to the inside of the downstream header section 3 and an opening 5*a* of the gas outlet pipe 5 within the downstream header section 3 faces the filter 6. According to the configuration, the compressed air does not flow as indicated by a dotted line arrow in FIG. 2A. That is, the compressed air discharged from the heat exchange section 1 can be prevented from discharging from the gas outlet pipe 5 by bypassing without colliding with the filter 6.

Thus, it is possible to further remove mist contained in the compressed air.

(Configuration of Heat Exchanger of Second Embodiment)

Figure 3:
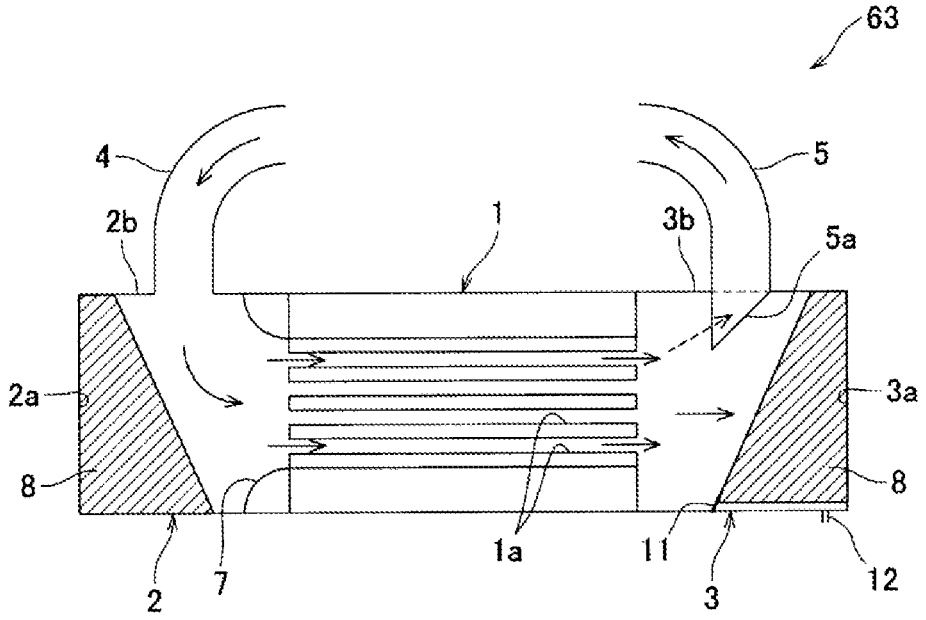
FIG. 3 is a view of a heat exchanger according to a second embodiment of the present invention.

FIG. 3 is a side sectional view of a heat exchanger 63 according to the second embodiment of the present invention. For the heat exchanger 63 according to the embodiment, the same reference numerals are given to the same components as the components configuring the heat exchanger 53 according to the first embodiment illustrated in FIGS. 2A and 2B (same for the other embodiments).

The difference between the heat exchanger 63 according to the embodiment and the heat exchanger 53 according to the first embodiment is a shape of the filter (filter-cum-sound absorbing material). The structure of the filter of the porous material, the density thereof and the like are the same in the filter 8 according to the embodiment and the filter 6 according to the first embodiment.

The thickness of the filter 6 according to the first embodiment is constant at all portions, but in the embodiment, the thickness of the filter 8 is changed so as to reduce resistance against the flow of the compressed air flowing into a header section. Since the shape of the filter 8 disposed within an upstream header section 2 and the shape of the filter 8 disposed within a downstream header section 3 are the same, on behalf of, the filter 8 disposed within the downstream header section 3 will be described.

As illustrated in FIG. 3, the surface of the filter 8 is an inclined surface with respect to a virtual extending direction of the heat exchange pipe 1*a* so that the compressed air discharged from a plurality of the heat exchange pipes 1*a* to an inside of the downstream header section 3 collides with a surface of the filter 8 and then flows to a gas outlet pipe 5. A thickness of the filter 8 on a bottom portion side of the downstream header section 3 is thick and the thickness on the gas outlet pipe 5 side is thin.

(Operations and Effects)

According to the shape of the filter 8, it is possible to impart a guide vane effect to the filter 8 and to reduce the resistance against the flow of the compressed air. In addition, since the thickness of the filter 8 is changed depending on portions, a frequency range of a high sound absorption coefficient becomes wide and it is possible to reduce sound of a wide frequency band.

(Configuration of Heat Exchanger of Third Embodiment)

Figure 4A:
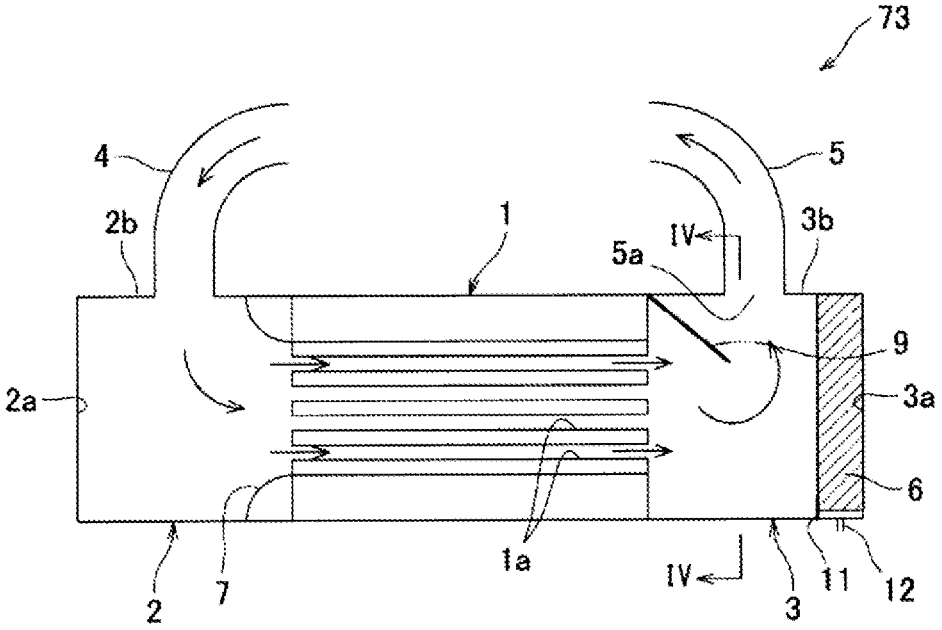
FIG. 4A is a side sectional view of a heat exchanger according to a third embodiment of the present invention.
Figure 4B:
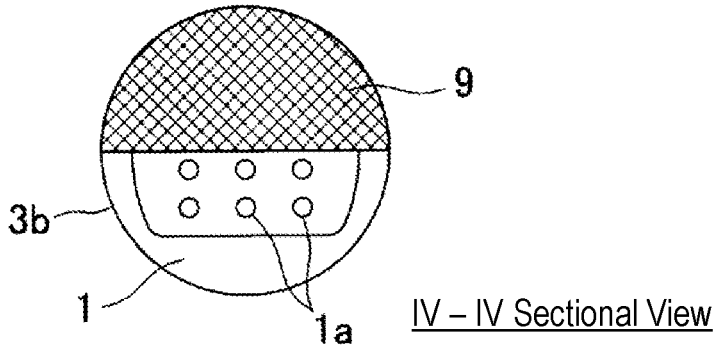
FIG. 4B is a sectional view that is taken along line IV-IV of FIG. 4A.

FIGS. 4A and 4B are views illustrating a heat exchanger 73 according to the third embodiment of the present invention. FIG. 4A is a side sectional view of the heat exchanger 73 and FIG. 4B is a sectional view that is taken along line IV-IV of FIG. 4A.

The difference between the heat exchanger 73 according to the embodiment and the heat exchanger 53 according to the first embodiment is that a shielding plate 9 is disposed within a downstream header section 3 of the heat exchanger 73. The shielding plate 9 is disposed within the downstream header section 3 so as to prevent short-circuiting of the compressed air from a heat exchange section 1 to a gas inlet section (opening 5*a*) of a gas outlet pipe 5.

As illustrated in FIGS. 4A and 4B, in the embodiment, the half-moon shape (semi-circular) shielding plate 9 is disposed within the downstream header section 3 so as to extend obliquely downward from an upper end portion of the heat exchange section 1 on a downstream side. In the embodiment, a gas outlet pipe 5 is not extended to the inside of the downstream header section 3.

(Operations and Effects)

The compressed air discharged from the heat exchange section 1 flows right obliquely downward as shown in figure by providing the shielding plate 9. Thus, the compressed air can be prevented from directly flowing out from the gas outlet pipe 5 without colliding with the filter 6.

(Configuration of Heat Exchanger of Fourth Embodiment)

Figure 5A:
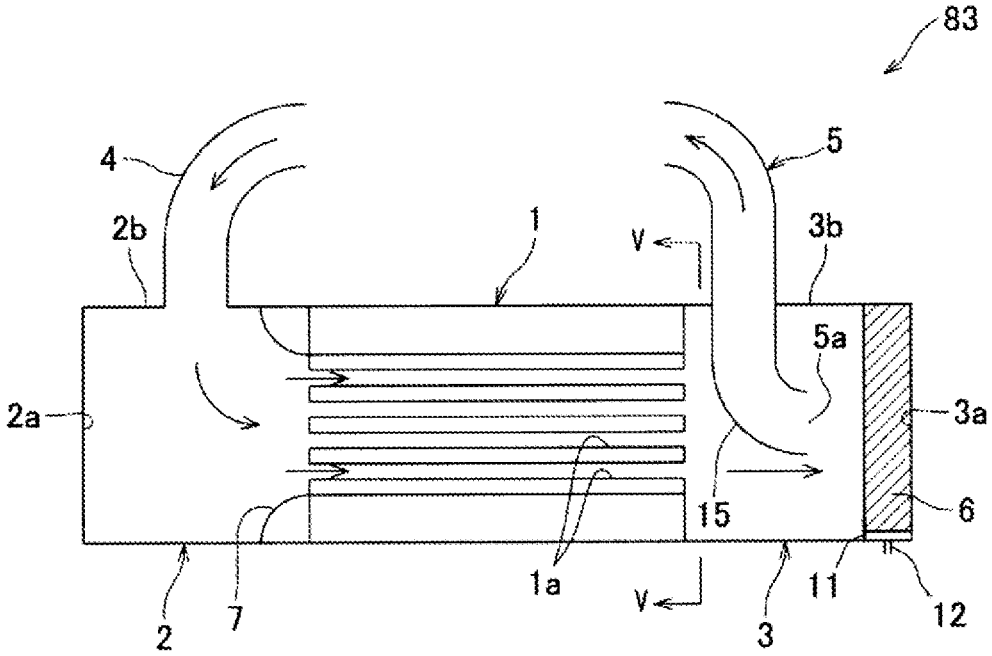
FIG. 5A is a side sectional view of a heat exchanger according to a fourth embodiment of the present invention.
Figure 5B:
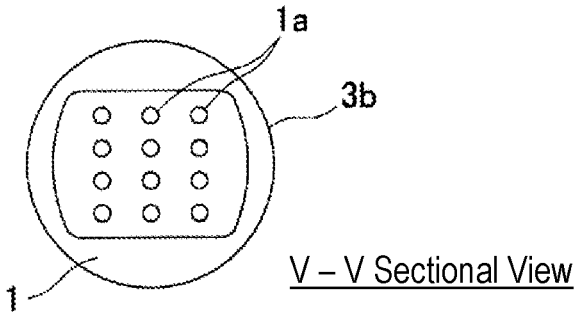
FIG. 5B is a sectional view that is taken along line V-V of FIG. 5A.

FIGS. 5A and 5B are views illustrating a heat exchanger 83 according to the fourth embodiment of the present invention. FIG. 5A is a side sectional view of the heat exchanger 83 and FIG. 5B is a sectional view that is taken along line V-V of FIG. 5A.

The difference between the heat exchanger 83 according to the embodiment and the heat exchanger 53 according to the first embodiment is the shape of the gas outlet pipe 5 on the upstream side (gas inlet side). A point that the opening 5*a* of the gas outlet pipe 5 within the downstream header section 3 face the filter 6 is the same in the embodiment and the first embodiment.

In the embodiment, the opening 5*a* faces the filter 6 by bending an end portion 15 of the gas outlet pipe 5 on the upstream side (gas inlet side) in a direction in which the filter 6 is positioned.

(Operations and Effects)

According to the configuration, similar to the case of the gas outlet pipe 5 according to the first embodiment, the compressed air discharged from the heat exchange section 1 can be prevented from discharging from the gas outlet pipe 5 by bypassing without colliding with the filter 6.

(Configuration of Heat Exchanger of Fifth Embodiment)

Figure 6A:
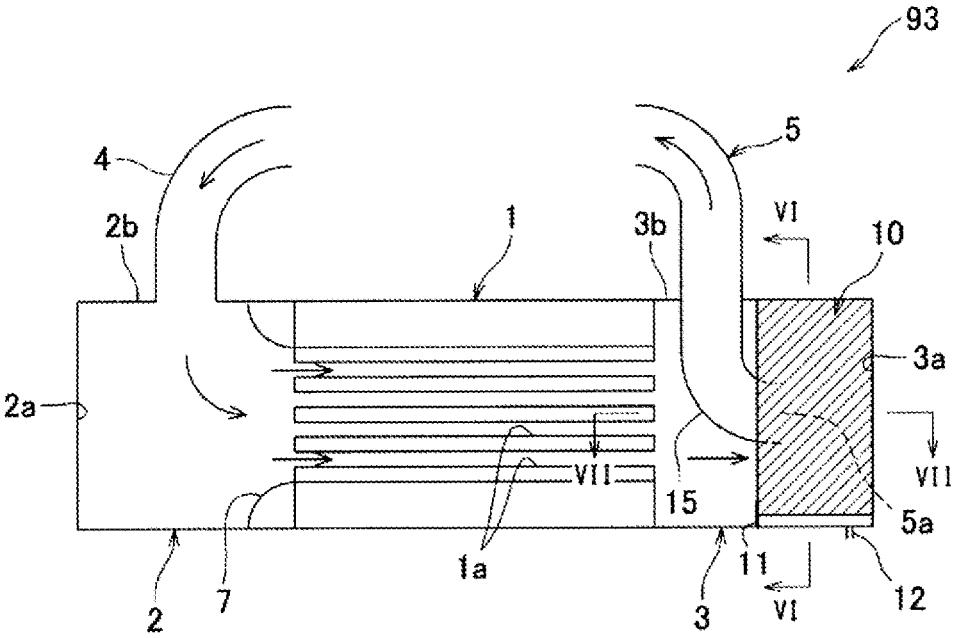
FIG. 6A is a side sectional view of a heat exchanger according to a fifth embodiment of the present invention.
Figure 6B:
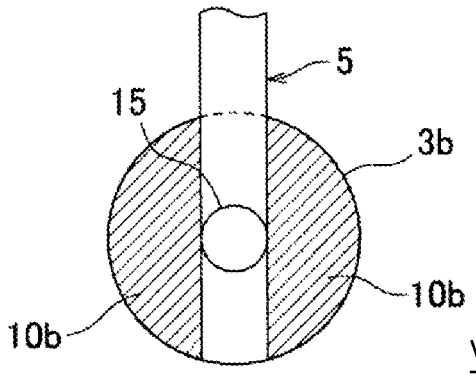
FIG. 6B is a sectional view that is taken along line VI-VI of FIG. 6A.
Figure 6C:
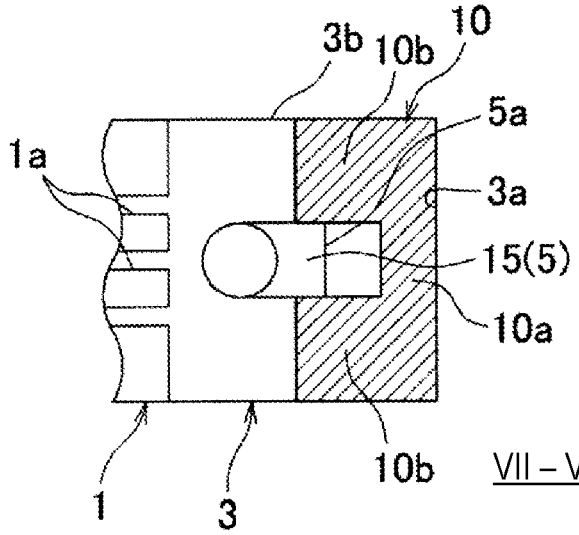
FIG. 6C is a sectional view that is taken along line VII-VII of FIG. 6A.

FIGS. 6A, 6B, and 6C are views illustrating a heat exchanger 93 according to the fifth embodiment of the present invention. FIG. 6A is a side sectional view of the heat exchanger 93, FIG. 6B is a sectional view that is taken along line VI-VI of FIG. 6A, and FIG. 6C is a sectional view that is taken along line VII-VII of FIG. 6A.

The difference between the heat exchanger 93 according to the embodiment and the heat exchanger 83 according to the fourth embodiment is the shape of the filter (filter-cum-sound absorbing material). The structure of the filter of the porous material, the density thereof and the like are the same in a filter 10 according to the embodiment and the filter 6 according to the fourth embodiment (first embodiment).

The filter 10 according to the embodiment is formed by extending both end portions of the filter 6 according to the fourth embodiment on the heat exchange section 1 side. The extended portion is a side portion 10*b* of the filter 10 and is illustrated in FIGS. 6B and 6C. As illustrated in FIG. 6C, the filter 10 has a U-shape in a plan sectional view. In addition, as illustrated in FIG. 6B, the side portion 10*b* of the filter 10 has a half-moon shape when the heat exchanger 93 is viewed from a front direction. The half-moon shape is provided to match a shape of the side portion 10*b* with a shape of a bent inner wall surface of a cylindrical shape of the downstream header section 3. The end portion 15 of the gas outlet pipe 5 on upper side (gas inlet side) is interposed between the side portions 10*b*.

Similar to other embodiments, a base portion 10*a* of the filter 10 comes into close contact and fixes with and to the inner wall surface 3*a* of the downstream header section 3 facing the heat exchange section 1.

(Operations and Effects)

According to the configuration, since a surface area of the filter 10 on an opening side (heat exchange section 1 side) is increased, sound absorption properties of the filter 10 are improved. In addition, a path from the heat exchange section 1 to the gas inlet section (opening 5*a*) of the gas outlet pipe 5 is lengthened and the compressed air is unlikely to linearly flow into the gas inlet section (opening 5*a*) of the gas outlet pipe 5. Thus, mist collection properties of the filter 10 are also improved.

As described above, the embodiments of the present invention are described, but the present invention is not limited to the above-described embodiments and is capable of being carried into practice with various modifications as long as set forth in the claims.

The gas (compressed gas) to be cooled, which flows through the heat exchanger in the present invention is not limited to the air (compressed air). The gas may be gas (compressed gas) such as nitrogen (compressed nitrogen) other than the air (compressed air).

This application is based on Japanese Patent Application No. 2013-160470 filed on Aug. 1, 2013, contents of which are incorporated herein by reference.

REFERENCE SIGNS LIST

1 Heat exchange section
2 Upstream header section
3 Downstream header section
4 Gas inlet pipe
5 Gas outlet pipe
6 Filter (filter-cum-sound absorbing material)
53 Heat exchanger

The invention claimed is:

1. A heat exchanger for a gas compressor, comprising:

a heat exchange section through which a compressed gas flows;

an upstream header section that is provided on an upstream side of the heat exchange section and communicates with the heat exchange section;

a downstream header section that is provided on an downstream side of the heat exchange section and communicates with the heat exchange section such that the upstream header section, the heat exchanger section and the downstream header section are arranged in this order along a longitudinal direction;

a gas inlet pipe that is connected to a wall surface of the upstream header section except a wall surface of the upstream header section which faces the heat exchange section; and a gas outlet pipe that is connected to a wall surface of the downstream header section except a wall surface of the downstream header section which faces the heat exchange section, wherein a filter-cum-sound absorbing material of a porous material is mounted on an inner wall surface of at least one of an upstream end wall surface of the upstream header section and a downstream end surface of the downstream header section, the inner wall surface facing the heat exchange section, wherein in a case where the filter-cum-sound absorbing material is mounted on the inner wall surface of the upstream header section, the gas inlet pipe is connected to a side wall surface of the upstream header section except an upstream end wall surface of the upstream header section which faces the heat exchange section, wherein in a case where the filter-cum-sound absorbing material is mounted on the inner wall surface of the downstream header section, the gas outlet pipe is connected to a side wall surface of the downstream header section except a downstream end wall surface of the downstream header section which faces the heat exchange section, wherein at least one of the gas inlet pipe and the gas outlet pipe has a portion thereof which extends in a direction perpendicular to the longitudinal direction, and wherein the gas outlet pipe extends to an inside of the downstream header section, and an opening of the gas outlet pipe within the downstream header section faces in a direction opposite to the heat exchange section and faces in a direction of the filter-cum-absorbing material mounted on the inner wall surface of the downstream header section.

2. The heat exchanger according to claim 1, wherein a thickness of the filter-cum-sound absorbing material is changed so as to reduce a resistance against a flow of the compressed gas which flows through the header section.

3. The heat exchanger according to claim 1, wherein the filter-cum-sound absorbing material is mounted on the inner wall surface of at least the downstream header section, the inner wall surface facing the heat exchange section.

4. The heat exchanger according to claim 3, wherein the gas outlet pipe extends to an inside of the downstream header section, and an opening of the gas outlet pipe within the downstream header section faces the filter-cum-sound absorbing material.

5. The heat exchanger according to claim 3, wherein a shielding plate that prevents a short-circuit flow of the compressed gas from the heat exchange section to a gas inlet section of the gas outlet pipe is disposed within the downstream header section.

6. The heat exchanger according to claim 2, wherein the filter-cum-sound absorbing material is mounted on the inner wall surface of at least the downstream header section, the inner wall surface facing the heat exchange section.

7. The heat exchanger according to claim 6, wherein the gas outlet pipe extends to an inside of the downstream header section, and an opening of the gas outlet pipe within the downstream header section faces the filter-cum-sound absorbing material.

8. The heat exchanger according to claim 6, wherein a shielding plate that prevents a short-circuit flow of the compressed gas from the heat exchange section to a gas inlet section of the gas outlet pipe is disposed within the downstream header section.

9. A heat exchanger for a gas compressor, comprising:

a heat exchange section through which a compressed gas flows;

an upstream header section that is provided on an upstream side of the heat exchange section and communicates with the heat exchange section;

a downstream header section that is provided on an downstream side of the heat exchange section and communicates with the heat exchange section such that the upstream header section, the heat exchanger section and the downstream header section are arranged in this order along a longitudinal direction;

a gas inlet pipe that is connected to a wall surface of the upstream header section except a wall surface of the upstream header section which faces the heat exchange section;

a shielding plate disposed within the downstream header section so as to extend obliquely downward from an upper end portion of the heat exchange section on a downstream side;

a filter-cum-sound absorbing material of a porous material mounted on an inner wall surface of a downstream end surface of the downstream header section, the inner wall surface facing the heat exchange section; and a gas outlet pipe directly connected to an upper wall surface of the downstream header section at a location between the shielding plate and the filter-cum-sound absorbing material mounted on the inner wall surface, wherein at least one of the gas inlet pipe and the gas outlet pipe has a portion thereof which extends in a direction perpendicular to the longitudinal direction.

* * * * *